United States Patent [19]

Jung

[11] Patent Number: 4,534,396

[45] Date of Patent: Aug. 13, 1985

[54] ROLLER SHADE RETURN MECHANISM

[76] Inventor: Stig Jung, Knivgatan 12, Malmö, Sweden

[21] Appl. No.: 522,361

[22] PCT Filed: Nov. 2, 1982

[86] PCT No.: PCT/SE82/00361

§ 371 Date: Jul. 21, 1983

§ 102(e) Date: Jul. 21, 1983

[87] PCT Pub. No.: WO83/01809

PCT Pub. Date: May 26, 1983

[30] Foreign Application Priority Data

Nov. 23, 1981 [SE] Sweden ..... 8106945

[51] Int. Cl.[3] ..... E06B 9/208

[52] U.S. Cl. ..... 160/298; 160/319

[58] Field of Search ..... 160/298, 299, 305, 307, 160/308, 319, 323–326

[56] References Cited

U.S. PATENT DOCUMENTS

| | | | |
|---|---|---|---|
| 305,455 | 9/1884 | Kempster | 160/308 |
| 1,321,674 | 11/1919 | Sheppard . | |
| 1,570,573 | 1/1926 | Nevatt | 160/307 |
| 2,166,745 | 7/1939 | Appel . | |
| 3,211,212 | 10/1965 | Smith . | |
| 4,096,904 | 6/1978 | Donofrio . | |
| 4,250,942 | 2/1981 | Dreher et al. | 160/323 R |

FOREIGN PATENT DOCUMENTS

| | | | |
|---|---|---|---|
| 2428730 | 2/1980 | France | 160/319 |

*Primary Examiner*—Peter M. Caun

*Attorney, Agent, or Firm*—Merchant, Gould, Smith, Edell, Welter & Schmidt

[57] ABSTRACT

A roller shade return mechanism comprises a rotary roller shade rod (1) which is rotatably mounted in relation to a non-rotary member (4) carrying a profiled pin (5) to be received in a roller shade mounting bracket. Characteristic of this mechanism is that the member (6) to be connected with the roller shade rod (1) is in the shape of an end plug adapted to be fixed in a recess at the end of the roller shade rod (1) and having a through bore to constitute a bearing rotatable together with the roller shade rod for a spindle (4) which is arranged in the roller shade rod and the outer end of which carries the profiled pin (5), part of the through bore in the end plug (6) being formed as a chamber (18) which accommodates a friction brake which includes a support washer (21) connected to the spindle (4), the bottom of the chamber (18) and at least two friction washers (22) arranged between the support washer and the chamber bottom, the two friction washers being annular and cup-shaped spring washers placed back to back and bearing with oppositely facing peripheral edges against the support washer (21), on the one hand, and the bottom of the chamber (18), on the other hand.

3 Claims, 4 Drawing Figures

12'
12
5
10
11
6
9
4
3
1
6'
4'
5'
2

ROLLER SHADE RETURN MECHANISM

The present invention relates to a roller shade return mechanism of the type described in the preamble of claim 1.

Roller shade return mechanisms with a rewinding spring in the roller shade rod and a device for manual lowering are generally equipped with a ratchet device which serves to hold the shade in the desired position and in other words to prevent unintentional raising. This well-known roller shade return mechanism also has well-known disadvantages and lately it has therefore been suggested to use instead of the conventional ratchet device a friction brake between a rotary member and a stationary member of the return mechanism and to use instead of the conventional pull cord a transmission of the sprocket and bead chain type. In this case the conventional rewinding spring can, if desired, be dispensed with or replaced by a weaker spring which only has the task of balancing the roller shade rod against the weight of the lowered shade. In roller shades of this type both raising and lowering of the shade is effected by means of the above-described transmission and the friction brake has for its object to prevent unintentional rotation of the roller shade rod and in the ideal case to give the roller shade return mechanism such a balance that the shade is automatically stopped in any desired position whatever as soon as the manual pull is caused to cease. A return mechanism of this kind is described in Swedish patent application No. 8106945-2.

According to said Swedish Patent Application there is inserted in each end of the roller shade rod an end plug which is provided with a pin of rectangular cross-section for insertion in a slot of a roller shade mounting bracket. One plug or both plugs form a bearing for the roller shade rod relative to a non-rotary spindle and housing for a friction brake of the above-mentioned kind, and one of the end plugs besides forms a holder for a sprocket which is included in the roller shade return mechanism and rotatable by means of bead chain.

The object of the present invention is to improve the roller shade return mechanism disclosed by Swedish Patent Application No. 8106945-2 and particularly the end plug with friction brake, sprocket and end cap or cover so that the parts can easily be assembled with the aid of as simple tools as possible or even without any tools. Other objects are to simplify and improve the brake housing and to make the brake mechanism more effective.

These objects have now been attained in that the return mechanism according to the invention has been given the characteristic features defined by the appended claims.

The invention will be more fully described hereinbelow with reference to the accompanying drawings in which.

Figure 1:
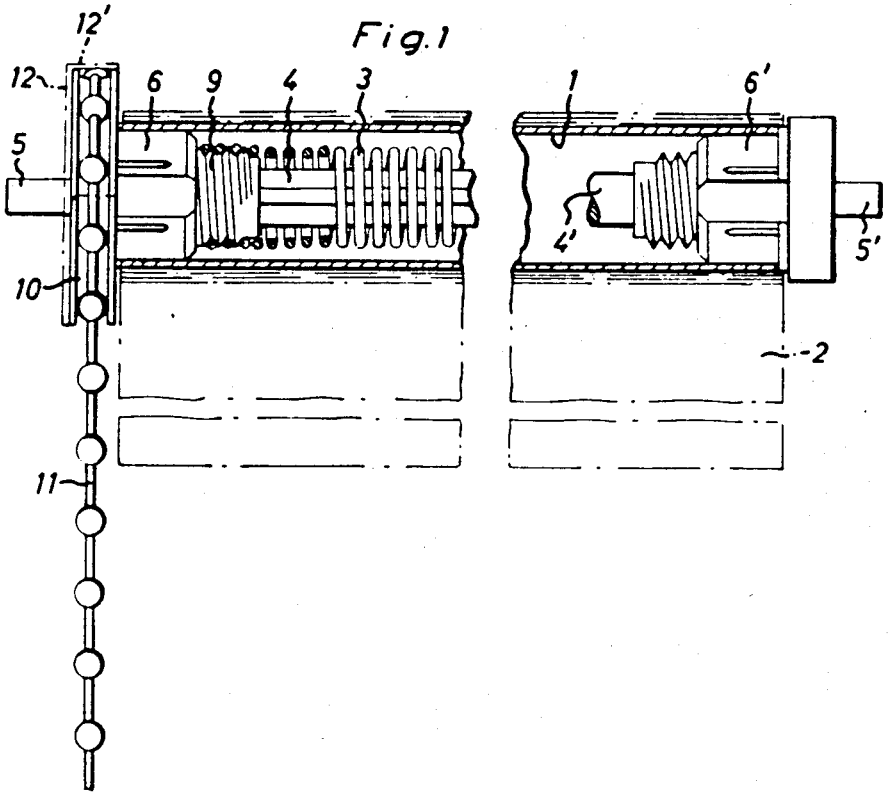
FIG. 1 is a side elevational view, partly in axial section, of a roller shade provided with a roller shade return mechanism according to the invention.

The roller shade according to the embodiment in FIG. 1 includes a rod 1 with a fabric 2 shown partially lowered. The roller shade rod 1 is tubular and in the hollow space thereof is arranged a rewinding spring 3 on a spindle 4 which at its outer end carries a pin 5 of rectangular cross-section, i.e. a customary so-called square pin for insertion in a slot of a roller shade mounting bracket (not shown). At the inner end the spring 3 is secured to the spindle 4 and bears at its outer (left) end against and is fixed to a plug 6 which is inserted in the left end portion (with regard to FIG. 1) of the tubular rod 1 and non-rotatably fixed in relation to the roller shade rod. The spindle 4 extends through and is rotatably mounted in the plug 6. Upon rotation of the roller shade rod 1 in relation to the pin 5 and the spindle 4 the spring 3 is thus tensioned in the same way as in conventional roller shades.

The plug 6 (shown in FIG. 1) in the left end portion of the tubular rod 1 is fixed against rotation relative to the rod 1 and carries on an end portion projecting from the rod a sprocket 10 which is fixed in relation to the plug 6 and thus also in relation to the roller shade rod 1. Through the shape of its circumference the sprocket is intended to be driven by means of a bead chain 11 of the type shown in FIG. 1 for lowering and raising the shade.

In the illustrated embodiment the plug 6 has a conical threaded inner projection 9 which engages in the adjoining end portion of the spring 3.

In the right end of the roller shade rod 1 there is also placed a plug 6' which may be of the same design as the already described plug 6. It is practical to use plugs 6 and 6' of the same design, as this makes it possible to use the same tools for the manufacture of the plugs which preferably are of plastic. The right spindle 4' shown in FIG. 1 is rotatably mounted in a manner similar to the spindle 4 in the corresponding plug 6' and may have a square pin 5'.

In an alternative embodiment the bead chain sprocket 10 can therefore be carried on the right plug 6' instead of the left plug 6.

As indicated at 12 by means of a dash and dot line a plate is disposed on the pin 5. A flange 12' of the plate encloses a part of the circumference of the sprocket 10 to prevent the bead chain 11 from unintentionally coming loose from the sprocket 10.

Figure 2:
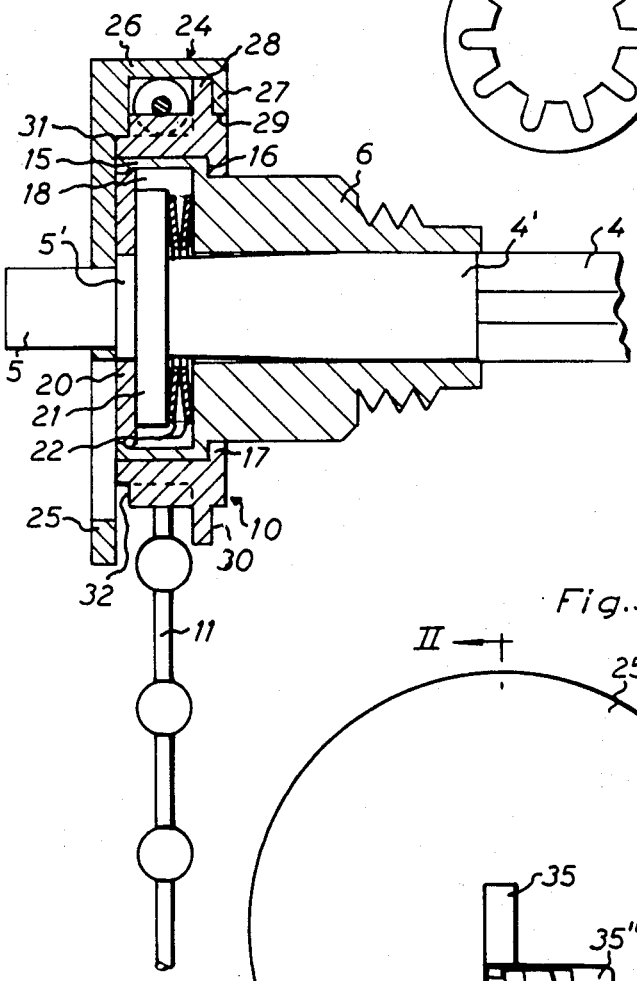
FIG. 2 is an axial sectional view taken on a larger scale of a preferred embodiment of the roller shade return mechanism according to the invention and illustrates in detail the elements housed in one end plug and in the sprocket, with mounted end cap.
Figure 3:
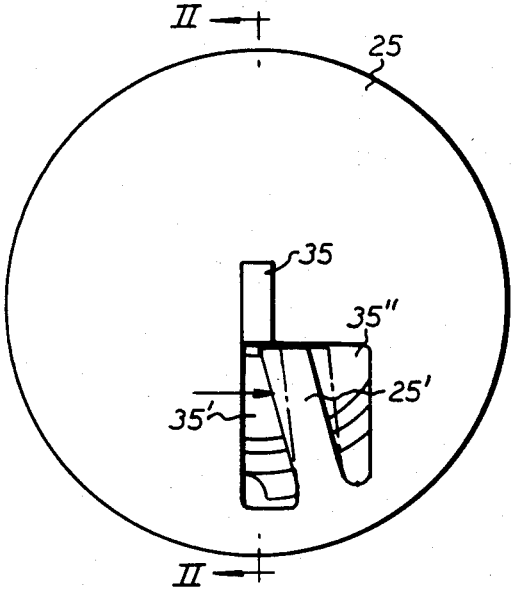
FIG. 3 is an end view as shown in the direction of the arrows III—III in FIG. 2.

In FIGS. 2 and 3 use is made of the same reference numbers as in FIG. 1 for elements having substantially similar or equal function as those described above.

Like the sprocket carrying plug 6 in FIG. 2 each of the plugs has an enlarged outer end portion which is delimited by a radial shoulder 16 from the remaining plug and forms a seat for the sprocket 10, which seat has a radially inwardly directed end flange 17 bearing against the shoulder 16. The sprocket can be mounted in a simple manner by being passed on to the plug 6 from the right with regard to FIG. 2 to a stop position in which the flange 17 bears against the shoulder 16. Of course there is also the alternative of inserting the plug 6 from the opposite direction in the sprocket 10.

The spindle 4 extends with a cylindrical or slightly conical portion 4' through a central bore in the plug 6 (see FIG. 2). At the outer end portion 5 of the plug said bore is widened so that the end portion 15 of the plug constitutes a housing with a chamber 18 for the friction brake. The spindle 4 may be made of plastic, while the square pin 5 preferably is of metal and is supported at the base of a stem portion of metal which is connected with the spindle 4. In FIG. 2 there is only shown an annular flange 5' of said stem portion. Said flange 5' serves as a support means for an annular washer 20 which is preferably made of plastic and detachably pressed onto the pin flange 5' and detachably urged into the bore at the outer end of the plug 6 so that the washer closes the chamber 18 at the outer end thereof. The washer 20 can be mounted in position by hand on the pin flange 5' and in the housing 15 and can be withdrawn by hand without any tool by first inserting the nail of a finger between the washer and the adjacent wall. Optionally, a simple tool, such as a small knife of a fine screw driver, can be used for detaching the washer 20. A plastic washer 21 is mounted on the spindle portion 4', bearing against the pin flange and forming a support washer in an axially outward direction for a set of friction washers 22 which in an axially inward direction rest on the bottom of the chamber 18.

Figure 4:
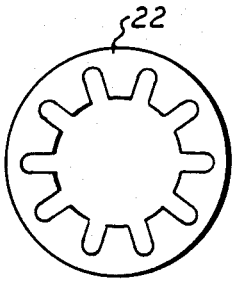
FIG. 4 is a plan view of a flexible friction washer according to the invention.

According to the invention, these friction washers consist of cup-shaped metal washers which are provided with a serrated inner edge portion of the shape shown in FIG. 4. The set of washers need only comprise two cup-shaped washers 22 which should preferably be placed back to back in the manner clearly apparent from FIG. 2. The washers 22 will as a result normally be separated from one another at their outer circumferential edges which bear against the support washer 21 and the bottom of the chamber 18, respectively. It should also be observed that the flexible friction washers 22 are kept pressed against one another at their radially inner edge portions which shall not normally bear against the support washer 21 and the bottom of the chamber 18, respectively.

The cup-shaped spring washers employed as friction washers, of the design appearing from FIGS. 2 and 4, have proved to produce a very advantageous friction braking effect. It might be assumed that the two friction washers 22 would be caused to rotate together when the plug 6 rotatably mounted on the end portion 4' of the spindle 4 and on the pin flange 5' rotates in relation to the pin 5 and the spindle 4. In reality, however, the support washer 21 retains one friction washer 22 while the bottom surface in the chamber 18 and thus the plug 6 retain the other friction washer. This is due to the retaining force acting over a larger radius than the friction force and signifies that one friction washer rotates together with the plug 6 and that the other friction washer is kept stationary together with the support washer 21 fixedly pressed onto the non-rotary spindle 4. Upon rotation of the roller shade rod 1 and the end plug 6 the two friction washers 22 are as a consequence rotated in relation to one another and therefore those surfaces are not abraded with which the friction washers are engaged at their outer edge portions, i.e. the inner side of the support washer 21 and the bottom of the chamber 18. When selecting material for the corresponding parts, i.e. the support washer and the plug, one need not therefore reckon with any critical abrasion through the friction washers. Besides the advantage is attained that one need not risk that the serrated friction surfaces will be worn bright and smooth to such an extent that the friction coefficient falls to an undesired low value. Compression of the friction washers to the desired extent is realized by urging the support washer 21 inwardly on the preferably slightly conical spindle portion 4'.

It will appear from the foregoing that the friction brake according to the invention provides several surprising disadvantages and is very easy to mount.

The closure washer 20 constitutes a means both for closing the chamber 18 and for more securely retaining the support washer 21 of the friction brake. The closure washer 20 is retained at its outer periphery to the plug 6 and is rotatable in relation to the pin flange 5', but a further support of the closure washer 20 is obtained with the aid of an end cap or cover, described in the following, which is generally designated 24 and shown in detail in FIGS. 2 and 3.

The end cover 24 includes a circular plate 25 which over approximately half its periphery carries an annular wall 26. Said wall 26 in turn carries at its axially inner end an annular radially directed flange 27. The sprocket 10 has a radially outwardly directed flange 28 which fits the inner side of the annular wall 26 of the cover 24, and between its axially inwardly facing side and the flange 28 the sprocket 10 has a shoulder 29 of the same width as the wall thickness of the flange 27 of the cover. In other words, the sprocket may be said to have a circular groove in its axially inwardly facing side, and said groove is entirely filled out by the cover flange 27 after the cover has been mounted in position on the pin 5 about the sprocket 10. In relation to said sprocket the cover 24 is furthermore supported by means of a shoulder 31 which rest on the bottom of an annular groove 32 in the axially outwardly facing side of the sprocket.

The cover can easily be mounted on the sprocket by insertion of the sprocket in the cover from the cover half devoid of the annular wall 26. The cover is then urged down into position on the flange 28 and the described support surfaces 29, 31.

The problem is to connect the cover 24 with the sprocket 10 and the pin 5 in a simple manner. According to the invention this connection has been realized as follows.

An aperture consisting of several portions is punched or otherwise provided in the circular disk-shaped cover wall 25. A portion of said aperture is in the form of a slot 35 the shape and dimensions of which corresponds to the shape and dimensions of the pin 5. It is readily realized that it would not be possible to mount the end cover in the above-described manner if the aperture in the wall 25 were formed only by the slot 35. Therefore the slot 35 connects onto a second aperture 35', one side of which lies in the same plane as a side of the slot 35. On the opposite side the aperture 35' is delimited by a portion 25' of the wall 25 and on the opposite side of the wall portion 25' the wall 25 has a further aperture 35''. Between the apertures 35' and 35'' and between the last-mentioned aperture and the slot 35 the wall portion 25' is cut away, whereby said wall portion 25' is in the form of a tongue. By making one aperture 35' narrower in its upper and wider in its lower part and by designing the other opening 35'' in the opposite way, i.e. by designing both apertures substantially triangular but with the bases turned in opposite directions the wall portion 25' is given an oblique shape and more particularly the shape of a spring tongue which can be bent with regard to FIG. 3 elastically towards the right to the position shown by dash and dot lines to allow a pin 5 inserted in the aperture 35' to penetrate to the slot 35. When the tongue is then released it flexes back to the position shown by full lines, thereby forming a support for one side of the pin 5. When the end cover is mounted the pin 5 is thus inserted in the aperture 35' whereupon the end cover in a position opposite the sprocket is moved at right angles to the spindle 4 to the described supporting position on the sprocket, and when the pin 5 passes into the slot 35, the wall tongue 25' bent towards the right with regard to FIG. 3 will flex back. The end cover is then maintained securely in position, keeping the end plug 6, the closure disk or plate 20 and the sprocket 10 assembled and retaining the bead chain which has been placed on the sprocket before the mounting operation.

It will be realized from the foregoing that the end cover constitutes a part of the mechanism according to the invention, which is of great importance in several respects and, as should be emphasized, also to a reliable function of the friction brake. Specifically, the disk-shaped wall of the cover should be continuous around the entire aperture 35, 35', 35'' therein in order to stabilize the wall against all forces from the roller shade rod and the respective pin 5 despite the existence of the apertures 35', 35'' below the slot 35 for the pin 5 in the position of use thereof.

I claim:

1. A roller shade return mechanism comprising a rotary roller shade rod, a drive for rotating the shade roll and a friction brake which comprises a plurality of washers and which acts between rotating and non-rotating members of the shade return machanism for holding the roller shade rod in selected positions of the shade, said roller shade rod having a recess in at least one end thereof and being rotatably mounted in relation to said non-rotary members, said non-rotary member comprising a non rotary spindle (4) mounted in said rod and supporting at one end thereof a non-rotary profiled pin (5) to be received in and supported by a roller shade mounting bracket, said rod being rotatable by a drive which comprises a sprocket (10) mounted on said rotatable member (6), the latter being arranged for connection with the roller shade rod, said sprocket being conformed to cooperate with a chain (11), wherein said rotatable member (6) is in the shape of an end plug adapted to be fixedly mounted in said recess at the end of the rod (1), said end plug having a throughbore to constitute a bearing to be rotatably mounted on said nonrotary spindle (4) at its outer end portion thereof adjacent said pin (5), said through-bore having, at its axially outer end, an enlargement forming a chamber (18), said chamber including, and being defined by, a peripheral wall and an axially inner bottom wall housing said friction brake, wherein said washers of said friction brake comprise a backing washer (21) non-rotatably supported by said non-rotary spindle (4) and at least two convex friction washers (22), each having a central aperture therethrough mounted on said non-rotary spindle in positions between the backing washer and said bottom wall of the chamber, said at least two friction washers mounted with convex sides in frictional abutment, one of said friction washers on the concave side thereof frictionally engaging the backing washer (21) at its peripheral outer edge; and wherein the other friction washer having its peripheral outer edge on the bottom wall of the chamber (18), each of said annular friction washers being serrated from its central aperture and radially outward.

2. A mechanism as claimed in claim 1, characterised in that the sprocket (10), the end plug (6) and the friction brake are kept assembled by a main assembling element (24) which is nonrotatably connected to the pin (5) at one side of the sprocket and which, on the opposite side of the sprocket, bears with a bearing surface (27) against a bearing surface (28) of the sprocket.

3. A mechanism as claimed in claim 2, characterised in that the main assembling element comprises a cover (24) including a disk-shaped wall (25) which supports a circular wall (26), said circular wall enclosing the outer periphery of the sprocket, said bearing surfaces being formed by a radially outwardly directed flange (28) of the sprocket and a radially inwardly directed flange (27) of said circular wall (26) of said cover, the diskshaped wall (25) of said cover having a slot (35) and first and second apertures (35', 35'') for receiving and retaining the pin (5), said first (35') aperture being in communication with said slot (35), and said second aperture (35'') being separated from said first aperture (35') by means of a spring tongue (25') formed by a portion of said disk-shaped wall between said first and second apertures, said tongue partially closing an entrance to said slot and forming a support for the pin (5) when received in the slot (35), said pin (5) being axially insertable into said first aperture (35') and radially movable therefrom into said slot (35) against the action of said spring tongue (25') which is elastically pivotable to open said entrance for permitting passage of said pin into or out of said slot, and said second aperture (35'') is formed to permit said elastic pivotal movement by receiving a portion of said spring tongue (25') when said tongue is elastically bent in a direction away from said first aperture (35').

* * * * *